US009530580B2

(12) United States Patent
Böttcher et al.

(10) Patent No.: US 9,530,580 B2
(45) Date of Patent: Dec. 27, 2016

(54) DRIVE FOR A SWITCHING DEVICE

(71) Applicant: Siemens Aktiengesellschaft, München (DE)

(72) Inventors: Martin Böttcher, Berlin (DE); Karsten Freundt, Falkensee (DE); Philipp Last, Berlin (DE); Maximilian Sieting, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/781,347

(22) PCT Filed: Apr. 15, 2014

(86) PCT No.: PCT/EP2014/057616
§ 371 (c)(1),
(2) Date: Sep. 30, 2015

(87) PCT Pub. No.: WO2014/173728
PCT Pub. Date: Oct. 30, 2014

(65) Prior Publication Data

US 2016/0035505 A1 Feb. 4, 2016

(30) Foreign Application Priority Data

Apr. 24, 2013 (DE) ..... 10 2013 207 436

(51) Int. Cl.
*H01H 3/46* (2006.01)
*H01H 3/52* (2006.01)

(52) U.S. Cl.
CPC *H01H 3/46* (2013.01); *H01H 3/52* (2013.01)

(58) Field of Classification Search
CPC ..... H01H 3/52; H01H 3/46
See application file for complete search history.

(56) References Cited

U.S. PATENT DOCUMENTS 1,764,415 A * 6/1930 Riley ..... H01H 3/46 200/401
3,402,373 A 9/1968 Werner
(Continued)

FOREIGN PATENT DOCUMENTS

DE 3201362 A1 1/1983
DE 4133092 A1 4/1993
(Continued)

OTHER PUBLICATIONS

International Search Report PCT/ISA/210 for International Application No. PCT/EP2014/057616 dated Aug. 6, 2014.
(Continued)

*Primary Examiner* — Mohamad Musleh
(74) *Attorney, Agent, or Firm* — Harness, Dickey & Pierce, P.L.C.

(57) ABSTRACT

A drive, for a switching device including a contact system with a fixed and a moving contact, including an actuator for operating the moving contact for closing or opening the contact system, and also a mechanical transmission device arranged between the moving contact and the actuator. The transmission device includes a toggle joint mechanism formed by a folding lever, pivotable about a stationary bearing, and a coupling element, connected to the folding lever via a moving bearing. The toggle joint mechanism is pivotable between a first end position and a second end position. When the changeover is made from the first to the second end position or vice versa, a maximum extended position occurs. The coupling element holds the moving contact in that position which closes the contact system in the first end position and in that position in which the contact system is open in the second end position.

22 Claims, 5 Drawing Sheets

(56) References Cited

U.S. PATENT DOCUMENTS

| | | | | | |
|---|---|---|---|---|---|
| 3,457,530 | A * | 7/1969 | Van Sickle | ..... | H01H 3/30 200/318 |
| 4,791,250 | A * | 12/1988 | Yin | ..... | H01H 3/30 200/17 R |
| 5,239,150 | A | 8/1993 | Bolongeat-Mobleu et al. | | |
| 5,523,536 | A | 6/1996 | Binder et al. | | |
| 8,581,128 | B2 | 11/2013 | Ito et al. | | |
| 2014/0167889 | A1 | 6/2014 | Einschenk et al. | | |

FOREIGN PATENT DOCUMENTS

| | | | |
|---|---|---|---|
| DE | 10049728 | | 1/2003 |
| JP | S49113150 | U | 9/1974 |
| JP | S61269817 | A | 11/1986 |
| JP | H05151867 | A | 6/1993 |
| JP | 2011134698 | A | 7/2011 |
| WO | WO-0227743 | | 4/2002 |
| WO | WO-2013004467 | | 1/2013 |

OTHER PUBLICATIONS

Written Opinion of the International Searching Authority PCT/ISA/237 for International Application No. PCT/EP2014/057616 dated Aug. 6, 2014.

German Office Action mailed Feb. 20, 2014.

Office Action for Japanese Patent Application No. 2016-509382 issued on Aug. 30, 2016 and English language translation thereof.

* cited by examiner

DRIVE FOR A SWITCHING DEVICE

PRIORITY STATEMENT

This application is the national phase under 35 U.S.C. §371 of PCT International Application No. PCT/EP2014/057616 which has an International filing date of Apr. 15, 2014, which designated the United States of America and which claims priority to German patent application number DE 102013207436.0 filed Apr. 24, 2013, the entire contents of which are hereby incorporated herein by reference.

FIELD

At least one embodiment of the invention generally relates to a drive for a switching device which has a contact system with a fixed contact and a moving contact.

BACKGROUND

A drive is known from international patent application WO 2013/004467 A1. This drive has an actuator for activating the moving contact and a mechanical transmission device which is arranged between the moving contact and the actuator. The actuator of the previously known drive comprises a lifting magnet which can be switched to and fro between two lifted positions. The locking of the two switched positions of the switching device is carried out by means of a stepped profile of a drive rod which is arranged between the actuator and the contact system.

SUMMARY

A drive for a switching device is disclosed in at least one embodiment, which can be easily fabricated and permits safe switching of the contact system.

At least one embodiment of the invention is directed to a drive. Advantageous refinements of the drive according to the invention are specified in dependent claims.

According to the above, there is provision according to at least one embodiment of the invention that the transmission device has a toggle joint mechanism which is formed by a folding lever, which can be pivoted about a stationary bearing, and a coupling element, which is connected to the folding lever via a moving bearing. The toggle joint mechanism can be pivoted between a first end position and a second end position. When the changeover is made from the first end position to the second end position or vice versa, a maximum extended position occurs. Further, the coupling element secures the moving contact in the first end position in the position which closes the contact system, and in the second end position in the position in which the contact system is opened.

At least one embodiment of the invention also relates to a switching device having a drive as has been described above. With respect to the advantages of the switching drive according to at least one embodiment of the invention, reference is made to the above statements relating to the drive according to at least one embodiment of the invention.

BRIEF DESCRIPTION OF THE DRAWINGS

The invention is explained in more detail below with reference to an example embodiment; in this context, in the drawings, by way of example:

FIG. 1 shows an example embodiment of a switching device according to the invention which is equipped with an exemplary embodiment of a drive according to the invention, wherein the drive has a toggle joint mechanism and the lifting drive, and wherein FIG. 1 shows the completely switched-on state of the switching device and a first lifted position of the lifting drive.

In the figures, for the sake of clarity the same reference symbols have always been used for identical or comparable components.

DETAILED DESCRIPTION OF EXAMPLE EMBODIMENTS

Figure 1:
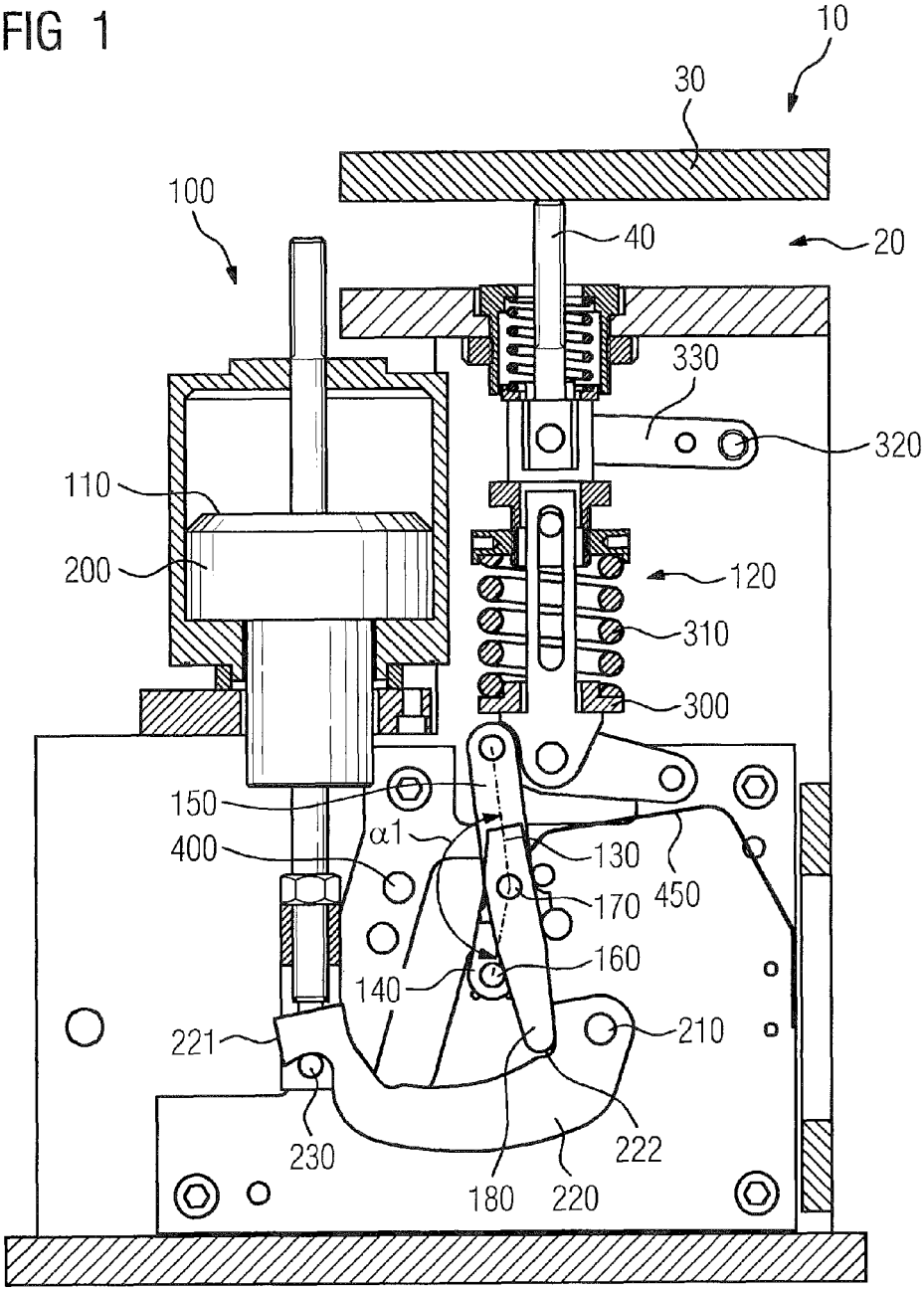

At least one embodiment of the invention is directed to a drive. Advantageous refinements of the drive according to the invention are specified in dependent claims.

According to the above, there is provision according to at least one embodiment of the invention that the transmission device has a toggle joint mechanism which is formed by a folding lever, which can be pivoted about a stationary bearing, and a coupling element, which is connected to the folding lever via a moving bearing. The toggle joint mechanism can be pivoted between a first end position and a second end position. When the changeover is made from the first end position to the second end position or vice versa, a maximum extended position occurs. Further, the coupling element secures the moving contact in the first end position in the position which closes the contact system, and in the second end position in the position in which the contact system is opened.

A significant advantage of the drive according to at least one embodiment of the invention is based on the toggle joint mechanism which can be switched to and fro between two end positions between which there is a maximum extended position. Such a toggle joint mechanism advantageously permits the movement behavior of the moving contact to be configured differently in the case of switching on of the switching device than in the case of switching off of the switching device. For example, it is possible in the case of switching off of the switching device to provide an intermediate position of the toggle joint mechanism in which a predefined distance is maintained between the moving contact and the fixed contact of the contact system before the switching device is completely switched off.

With respect to the connection of the toggle joint mechanism to the moving contact of the contact system it is considered advantageous if the coupling element is connected to the moving contact via a lifting element and a contact pressure spring, and in the extended position the coupling element applies a maximum pressure force to the moving contact via the lifting element and the contact pressure spring.

The toggle joint mechanism preferably forms a component of a linkage.

For example, the toggle joint mechanism can form a component of a multi-joint chain, in particular of a four-joint chain, or of a multi-bar linkage, in particular of a four-bar linkage.

The first end position and the second end position are preferably arranged asymmetrically with respect to the extended position. It is considered particularly advantageous in this respect if in the first end position the toggle joint mechanism has a first extension angle between the folding lever and the coupling element, and in the second end position a second extension angle between the folding lever and the coupling element, and the first extension angle of the toggle joint mechanism is larger than the second extension angle of the toggle joint mechanism.

A control lever is preferably used to adjust the toggle joint mechanism; accordingly, it is considered advantageous if a control lever, with which the toggle joint mechanism can be moved from the first end position to the second end position or vice versa, is additionally connected to the moving bearing.

The control lever can advantageously be deflected by a gate lever which can be pivoted about a second stationary bearing.

The drive preferably also has a lifting drive which can assume a first lifted position and a second lifted position. If such a lifting drive is present, it is also considered advantageous if the lifting drive is coupled to the toggle joint mechanism in such a way that a changeover of the lifting drive from the first lifted position into the second lifted position and back again to the first lifted position causes the end position of the toggle joint mechanism to be reset, specifically either from the first end position into the second end position or from the second end position into the first end position.

According to at least one embodiment, in one particularly preferred refinement of the drive there is provision that the lifting drive is connected to the gate lever, which can be pivoted about the second stationary bearing, in such a way that when a changeover is made from the first lifted position into the second lifted position said lifting drive pivots in the direction of the moving bearing, and when a changeover is made from the second lifted position into the first lifted position it pivots away from said moving bearing.

According to at least one embodiment, in one particularly preferred refinement of the drive there is provision that when the changeover is made from the first lifted position to the second lifted position, the lifting drive extends the toggle joint mechanism from the first end position of the toggle joint mechanism by means of the control lever and moves it beyond the extended position into an intermediate folded position, and when the changeover is made from the second lifted position to the first lifted position said lifting drive moves said toggle joint mechanism from this intermediate folded position into the second end position of the toggle joint mechanism.

It is also advantageous if when the changeover is made from the first lifted position to the second lifted position, the lifting drive extends the toggle joint mechanism from the second end position of the toggle joint mechanism by means of the control lever, and moves it beyond the extended position directly—without remaining in an intermediate folded position—to the first end position of the toggle joint mechanism.

The control lever preferably is not pivoted from the respective control lever end position present at the first lifted position to the respective other control lever end position until the changeover from the second lifted position to the first lifted position.

In its first control lever end position which it assumes in the first end position of the toggle joint mechanism, the control lever preferably bears against a first support point on the gate lever. In its second control lever end position which it assumes in the second end position of the toggle joint mechanism, said control lever preferably bears against a second support point on the gate lever or is separated therefrom.

In order to pivot the control lever it can be provided, for example, that the drive has one or more control lever stops (for example in the form of a spring). The pivoting of the control lever from the first control lever end position to the second control lever end position is preferably brought about by a first control lever stop, against which the control lever is pressed during the further movement of the moving bearing during the changeover from the second lifted position into the first lifted position or during the changeover from the intermediate folded position of the toggle joint mechanism into the second end position of the toggle joint mechanism.

Alternatively or additionally, the drive can have a (second) control lever stop (for example in the form of a spring) which brings about the pivoting of the control lever from the second control lever end position to the first control lever end position if, during the changeover from the second lifted position into the first lifted position, the control lever is pressed against said control lever stop.

The intermediate folded position which the toggle joint mechanism reaches from the first end position is preferably selected in such a way that although the contact system is opened to such an extent that an arc which occurs between the fixed contact and the moving contact in the case of switching off just goes out and the return tension is maintained, the completely opened contact position of the contact system is still not reached.

The lift drive is preferably a magnetic drive whose first lifted position and/or whose second lifted position are respectively maintained by magnetic forces and/or spring forces.

At least one embodiment of the invention also relates to a switching device having a drive as has been described above. With respect to the advantages of the switching drive according to at least one embodiment of the invention, reference is made to the above statements relating to the drive according to at least one embodiment of the invention.

FIG. 1 shows a switching device 10 which is equipped with a contact system 20 with a stationary contact, referred to below as a fixed contact 30, and a moving contact 40, referred to below as the moving contact 40.

In order to move the moving contact 40 and to switch the switching device 10 on and off, the switching device 10 is equipped with a drive 100 which comprises an actuator in the form of a lifting drive 110 and a transmission device 120. The transmission device 120 is arranged between the lifting drive 110 and the moving contact 40 and transmits the lifting movement and the force of the lifting drive 110 to the moving contact 40.

The transmission device 120 comprises a toggle joint mechanism 130 which has a folding lever 140 and a coupling element 150. The folding lever 140 is mounted so as to be pivotable about a stationary bearing 160. In order to connect the folding lever 140 to the coupling element 150, a moving bearing 170 is used, on which moving bearing 170 a control lever 180 is additionally secured in a pivotable fashion.

Figure 3:
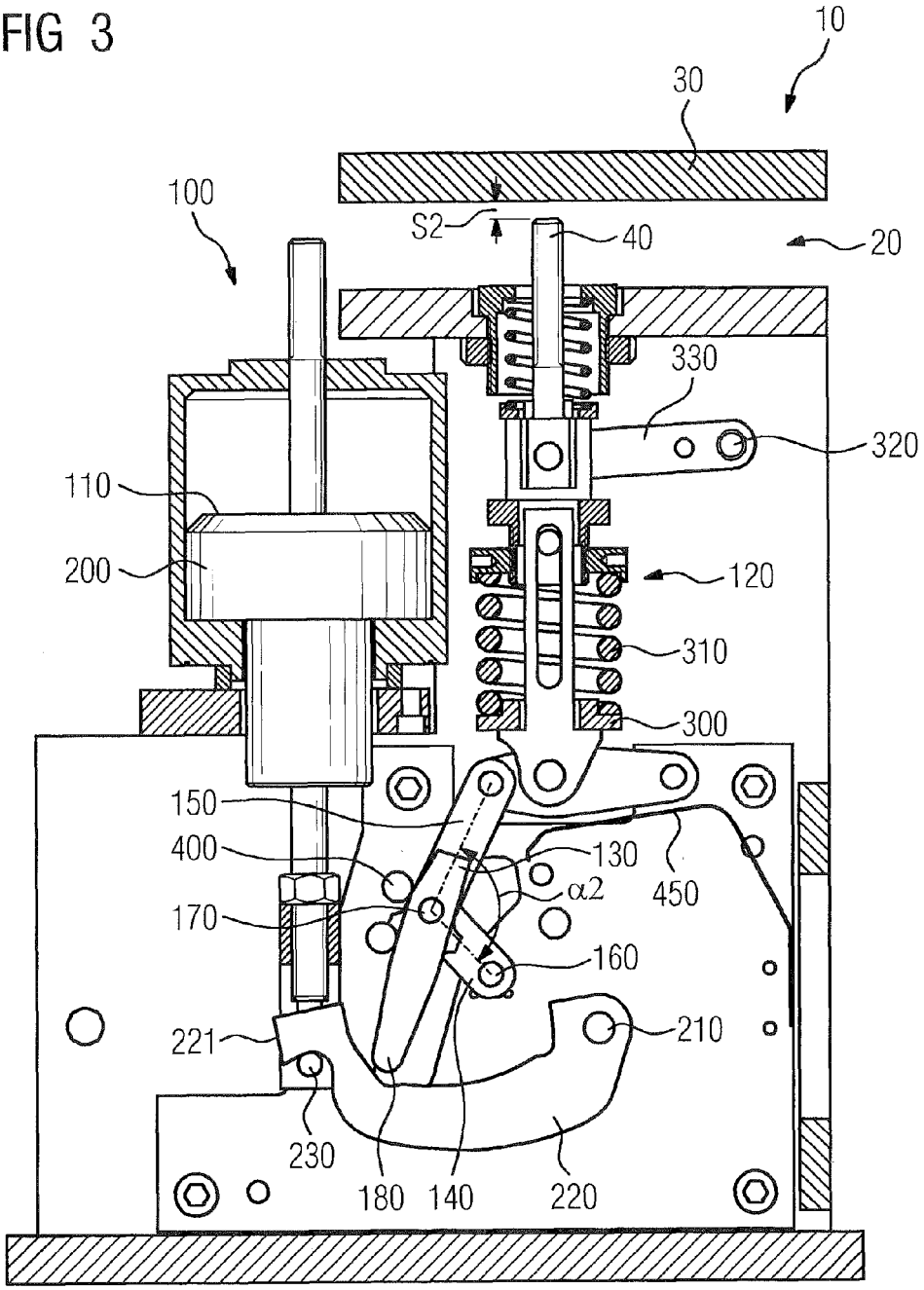
FIG. 3 shows the completely switched-off state of the switching device which the switching device reaches when the toggle joint mechanism has been moved from the intermediate folded position according to FIG. 2 into its second end position, and the lifting drive has been moved into its first lifted position.

The toggle joint mechanism 130 can be pivoted between a first end position, as is shown in FIG. 1, and a second end position as is shown in FIG. 3. When the changeover is made from the first end position into the second end position or vice versa, the toggle joint mechanism 130 passes through a maximum extended position (cf. FIG. 4).

In the first end position of the toggle joint mechanism 130 (cf. FIG. 1), the coupling element 150 secures the moving contact 40 in the position which closes the contact system 20, wherein the contact pressure spring 310 is tensioned to an almost maximum extent. In the second end position of the toggle joint mechanism 130, as shown in FIG. 3, the coupling element 150 secures the moving contact 40 in an open position in which the contact system 20 is electrically opened. The transition of the first end position of the toggle joint mechanism 130 into the second end position and vice versa will be explained in more detail below with reference to FIGS. 2 to 5.

The lifting drive 110, which is equipped with an anchoring element 200, is used to adjust the toggle joint mechanism 130 from the first end position (cf. FIG. 1) into the second end position. In the first lifted position illustrated in FIG. 1, the anchoring element 200 is in its lower end position in which it pivots downward a gate lever 220 which can be pivoted about a second stationary bearing 210 and has a gate lever driver 230. The gate lever 220 interacts with the control lever 180 when the gate lever 220 is pivoted upward about the second stationary bearing 210, with the result that it is possible to adjust the end position of the toggle joint mechanism 130 by means of the control lever 180.

A lifting element 300 and a contact pressure spring 310 are connected to the coupling element 150 and are in turn coupled to the moving contact 40 via a pivoting lever 330 which can pivot about a third stationary bearing 320.

The adjustment of the switching device 10 from the switched-on state illustrated in FIG. 1 to the switched-off state illustrated in FIG. 3 will be explained in more detail below with reference to FIGS. 1 to 3.

Figure 2:
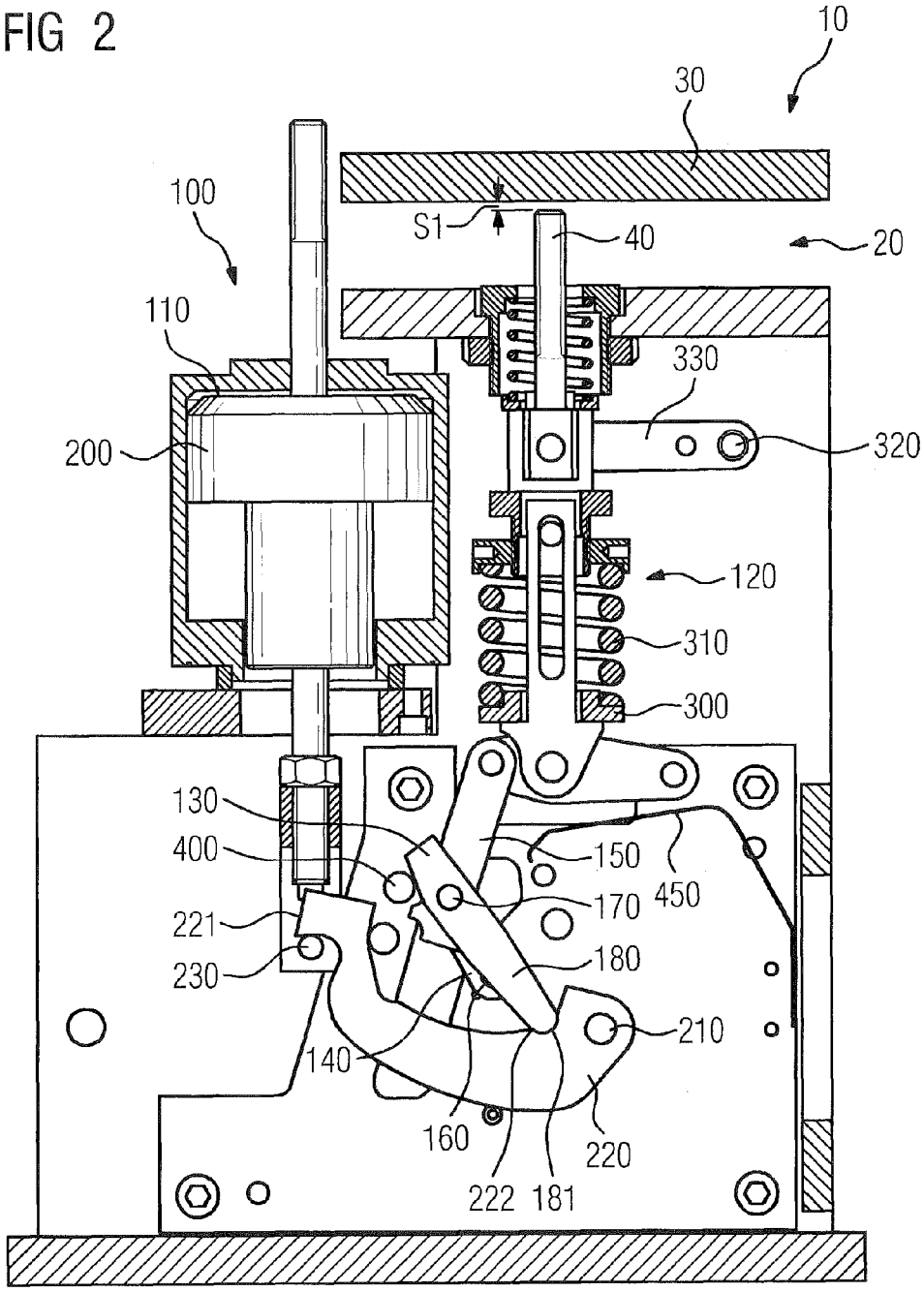
FIG. 2 shows an intermediate folded position which the toggle joint mechanism according to FIG. 1 assumes during the switching off of the switching device as soon as the lifting drive reaches its second lifted position.

In order to switch off the switching device 10, the anchoring element 200 of the lifting drive 110 is firstly moved upward into the second lifted position shown in FIG. 2. As a result of the upward movement of the anchoring element 200, the lever end 221 of the gate lever 220 is pivoted upward about the second stationary bearing 210 in FIG. 1, as a result of which the control lever 180 is lifted and the moving bearing 170 of the toggle joint mechanism 130 is shifted. The toggle joint mechanism 130 moves into an intermediate folded position in which the contact system 20 is already open to such an extent that an arc which occurs between the fixed contact 30 and the moving contact 40 when the contact system 20 is switched off just goes out. The distance between the moving contact 40 and the fixed contact 30 is characterized by the reference symbol S1 in FIG. 2. The completely opened contact position of the contact system 20 is not yet reached in FIG. 2 or in the second lifted position of the lifting drive 110.

FIG. 3 shows the switching device 10 after the anchoring element 200 has been moved back from the second lifted position illustrated in FIG. 2 into the first lifted position, that is to say downward on the basis of FIG. 2. It is apparent that the moving bearing 170 of the toggle joint mechanism 130 has moved even further to the left, as a result of which the distance between the moving contact 40 and the fixed contact 30 has been increased. The distance between the moving contact 40 and the fixed contact 30 is characterized in FIG. 3 by the reference symbol S2; the following applies $$S2>S1.$$

In FIG. 3, it is also apparent that when the changeover of the anchoring element 200 is made from the second lifted position into the first lifted position or when the moving bearing 170 pivots to the left, the control lever 180 is pivoted against a control lever stop 400, with the result that the control lever 180 pivots about the moving bearing 170 when the gate lever 220 is lowered. As a result of the pivoting of the control lever 180, the control lever end 181 of the control lever 180 leaves the support point 222 on the gate lever 220 (cf. FIG. 2) and pivots into a control lever position in which the control lever 180 either bears on another support point on the gate lever 220 or else is completely separated from it. The last-mentioned variant is shown in FIG. 3.

In the position of the lifting drive 110 and of the contact system 20 shown in FIG. 3, the switching device 10 is completely switched off, and the toggle joint mechanism 100 and the control lever 180 have reached their end position.

Figure 4:
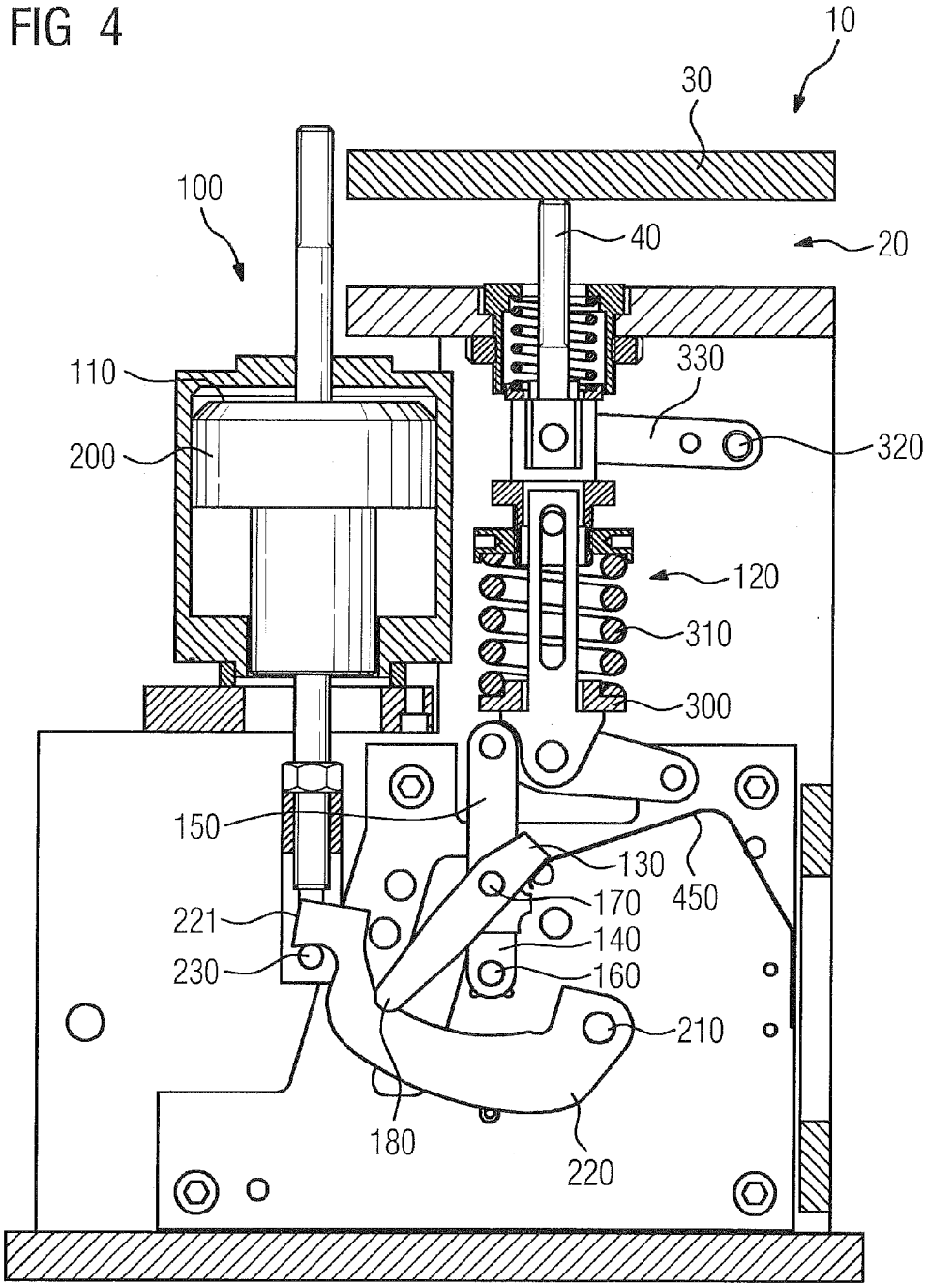
FIG. 4 shows an extended position which the toggle joint mechanism passes through when the switching device is switched on, and FIG. 5 shows the state of the switching device when the lifting drive is moved into its second lifted position during the switching-on process, that is to say before the switching over of the lifting drive from the second lifted position into the first lifted position.

The switching on again of the switching device 10 from the position illustrated in FIG. 3 will be explained in more detail below with reference to FIGS. 3 to 5:

Starting from the completely switched-off state of the switching device 10 illustrated in FIG. 3, the lifting drive 110 is firstly activated, and the anchoring element 200 is lifted until the toggle joint mechanism 130 reaches the extended position illustrated in FIG. 4. It is apparent that the extended position of 180° of the toggle joint mechanism 130 is already reached before the anchoring element 200 has assumed its second upper lifting position.

Furthermore, in FIG. 4 it is apparent that the moving contact 40 has already reached the fixed contact 30 and the contact system 20 is already closed and the contact pressure spring 310 is tensioned to a maximum extent. The switching device 10 is therefore in the switched-on state even before the anchoring element 200 has reached the second lifted position.

Figure 5:
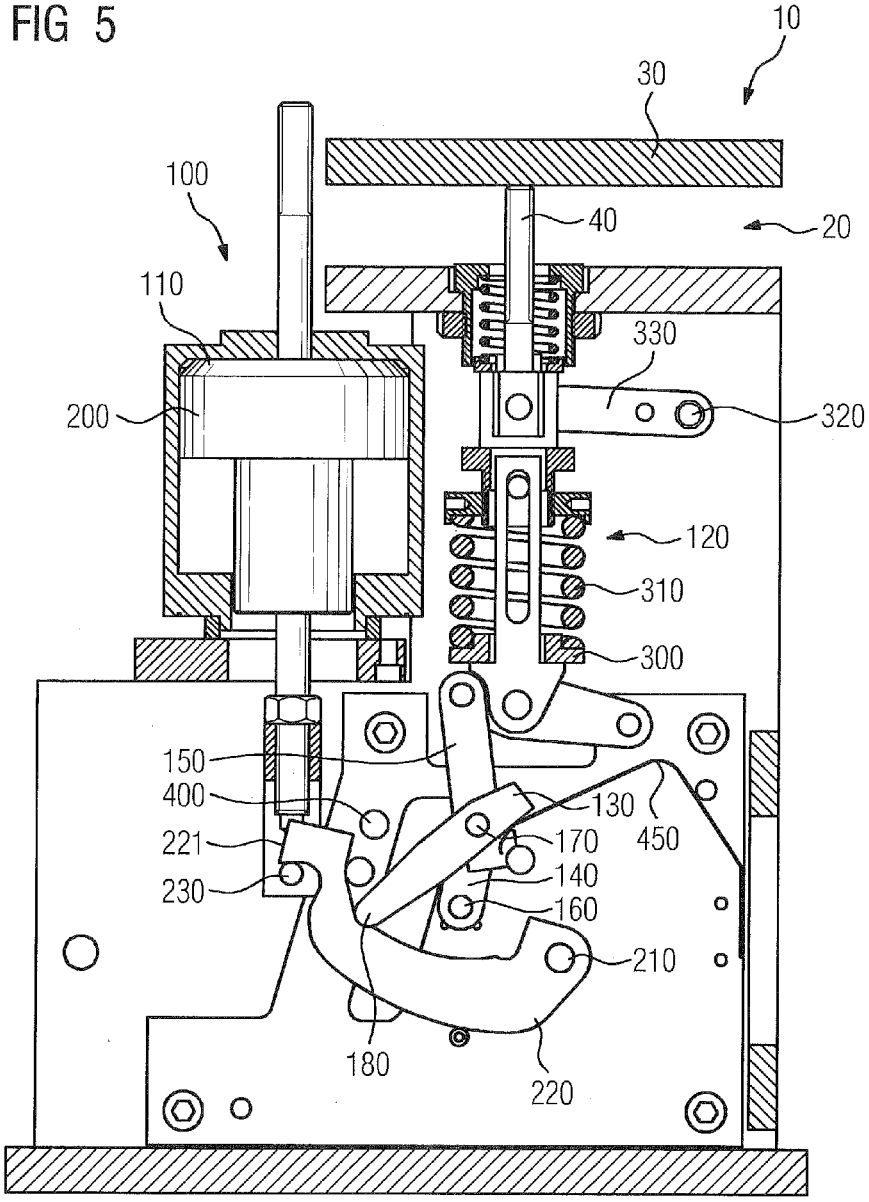

FIG. 5 illustrates the state of the switching device 10 after the anchoring element 200 or the lifting drive 110 has been moved into the second lifted position. It is apparent that when the changeover is made from the position illustrated in FIG. 4 to the position illustrated in FIG. 5, the moving bearing 170 of the toggle joint mechanism 130 has moved slightly further to the right, with the result that slight lowering of the coupling element 150 has also occurred. In spite of the lowering of the coupling element 150, the position of the moving contact 40 has, however, not changed, with the result that the switching device 10 remains in the switched-on state, as has already been shown in FIG. 4.

FIG. 5 also shows that when the toggle joint mechanism 130 pivots to the right, the control lever 180 has been pushed against a spring 450, as a result of which the spring 450 has been tensioned at least slightly. If, in the further course of the switching, the anchoring element 200 is then lowered and the lifting drive 110 is moved back into the first lifted position, the gate lever 220 pivots downward about the second stationary bearing 210, as a result of which the control lever 180 can be pivoted back by the spring 450 from the position illustrated in FIG. 5 to the position illustrated in FIG. 1. In this pivoted-back position, the control lever 180 bears with its control lever end 181 on the support point 222 on the gate lever 220. The position of the toggle joint mechanism 130 and the state of the contact pressure spring 310 remain unchanged here.

In FIGS. 1 and 3 it is apparent that the toggle joint mechanism 130 in the exemplary embodiment according to FIGS. 1 to 5 has a larger extension angle between the folding lever 140 and the coupling element 150 in the first end position (cf. FIG. 1) than in the second end position. In the first end position (illustrated in FIG. 1) of the toggle joint mechanism 130, the extension angle is characterized by the reference symbol $\alpha 1$, and in the second end position the extension angle has the reference symbol $\alpha 2$ in FIG. 3. In other words, the first end position and the second end position are asymmetrical with respect to the maximum achievable "extended position".

The toggle joint mechanism 130 which is shown in FIGS. 1 to 5 can form a component of a linkage. For example, the toggle joint mechanism 130 can be a component of a multi-joint chain, in particular of a four-joint chain, or of a multi-bar linkage, in particular of a four-bar linkage.

As is apparent from the above explanations relating to FIGS. 1 to 5, when the changeover is made from the first lifted position into the second lifted position the lifting drive 110 extends the toggle joint mechanism 130 from the first end position (cf. FIG. 1) of the toggle joint mechanism 130 (that is to say from the switched-off switched state of the switching device 10) by means of the control lever 180 and moves it beyond the extended position into an intermediate folding position, as is shown in FIG. 2. When this changeover is made from the second lifted position into the first lifted position, the toggle joint mechanism 130 is moved from this intermediate folded position (cf. FIG. 2) into the second end position of the toggle joint mechanism 130 (cf. FIG. 3).

Starting from the second end position (cf. FIG. 3) of the toggle joint mechanism 130 (that is to say when the switching device 10 is switched on from the switched-off switched state), when the changeover is made from the first lifted position into the second lifted position the lifting drive 110 extends the toggle joint mechanism 130, by means of the control lever 180, beyond the extended position directly into the first end position of the toggle joint mechanism 130, without—in contrast to the switch-off process—remaining in an intermediate folded position.

When the switching device 10 is switched on, the changeover of the switched state takes place, in other words, already when the changeover is made from the first lifted position into the second lifted position, whereas when the switching device 10 is switched off, an intermediate state in the form of the intermediate folded position is selectively set. In the intermediate folded position, the contacts of the contact system 20 are already open to such an extent that an arc goes out, whereas the switching device 10 is not yet completely switched off. This makes it possible to allow the switching device 10 to remain in an intermediate state in which it is possible to wait until the arc goes out before the contacts of the contact system 20 are completely opened.

LIST OF REFERENCE SYMBOLS

10 switching device
20 contact system
30 fixed contact
40 moving contact
100 drive
110 actuator/lifting drive
120 transmission device
130 toggle joint mechanism
140 folding lever
150 coupling element
160 stationary bearing
170 moving bearing
180 control lever
181 control lever end
200 anchoring element
210 stationary bearing
220 gate lever
221 lever end
222 support point
230 gate lever driver
300 lifting element
310 contact pressure spring
320 stationary bearing
330 pivoting lever
400 control lever stop
450 spring
S1 distance
S2 distance
$\alpha 1$ extension angle
$\alpha 2$ extension angle

The invention claimed is:

1. A drive for a switching device, the switching device including a contact system with a fixed contact and a moving contact, the drive comprising:

an actuator for activating the moving contact to close or open the contact system; and a mechanical transmission device, arranged between the moving contact and the actuator, including a toggle joint mechanism, formed by a folding lever and pivotable about a stationary bearing between a first end position and a second end position, wherein when a changeover is made from the first end position to the second end position or vice versa, a maximum extended position occurs, and a coupling element, connected to the folding lever via a moving bearing, the coupling element securing the moving contact in the first end position in the position which closes the contact system, and in the second end position in the position in which the contact system is opened, wherein a control lever, with which the toggle joint mechanism is movable from the first end position to the second end position or vice versa, is additionally connected to the moving bearing, and wherein the control lever is deflectable by a gate lever, the gate lever being pivotable about a second stationary bearing.

2. The drive of claim 1, wherein the coupling element is connected to the moving contact via a lifting element and a contact pressure spring, and wherein, in the extended position, the coupling element applies a maximum pressure force to the moving contact via the lifting element and the contact pressure spring.

3. The drive of claim 2, wherein, in the first end position, the toggle joint mechanism includes a first extension angle between the folding lever and the coupling element, and in the second end position, the toggle joint mechanism includes a second extension angle between the folding lever and the coupling element, and wherein the first extension angle of the toggle joint mechanism is relatively larger than the second extension angle of the toggle joint mechanism.

4. The drive of claim 2, further comprising:

a lifting drive, configured to be able to assume a first lifted position and a second lifted position.

5. The drive of claim 4, wherein the lifting drive is coupled to the toggle joint mechanism such that a changeover of the lifting drive from the first lifted position into the second lifted position and back again to the first lifted position causes the end position of the toggle joint mechanism to be reset, either from the first end position into the second end position or from the second end position into the first end position.

6. The drive of claim 2, wherein the toggle joint mechanism forms a component of a linkage.

7. A switching device comprising the drive of claim 2.

8. The drive of claim 1, wherein, in the first end position, the toggle joint mechanism includes a first extension angle between the folding lever and the coupling element, and in the second end position, the toggle joint mechanism includes a second extension angle between the folding lever and the coupling element, and wherein the first extension angle of the toggle joint mechanism is relatively larger than the second extension angle of the toggle joint mechanism.

9. The drive of claim 1, further comprising:

a lifting drive, configured to be able to assume a first lifted position and a second lifted position.

10. The drive of claim 9, wherein the lifting drive is coupled to the toggle joint mechanism such that a changeover of the lifting drive from the first lifted position into the second lifted position and back again to the first lifted position causes the end position of the toggle joint mechanism to be reset, either from the first end position into the second end position or from the second end position into the first end position.

11. The drive of claim 10, wherein the lifting drive is connected to the gate lever, pivotable about the second stationary bearing such that when a changeover is made from the first lifted position into the second lifted position, said lifting drive pivots in the direction of the moving bearing, and when a changeover is made from the second lifted position into the first lifted position, said lifting drive pivots away from said moving bearing.

12. The drive of claim 10, wherein when the changeover is made from the first lifted position to the second lifted position, the lifting drive extends the toggle joint mechanism from the first end position of the toggle joint mechanism via the control lever and moves the toggle joint mechanism beyond the extended position into an intermediate folded position, and when the changeover is made from the second lifted position to the first lifted position, said lifting drive moves said toggle joint mechanism from the intermediate folded position into the second end position of the toggle joint mechanism.

13. The drive of claim 9, wherein the lifting drive is connected to the gate lever, pivotable about the second stationary bearing such that when a changeover is made from the first lifted position into the second lifted position, said lifting drive pivots in the direction of the moving bearing, and when a changeover is made from the second lifted position into the first lifted position, said lifting drive pivots away from said moving bearing.

14. The drive of claim 13, wherein when the changeover is made from the first lifted position to the second lifted position, the lifting drive extends the toggle joint mechanism from the first end position of the toggle joint mechanism via the control lever and moves the toggle joint mechanism beyond the extended position into an intermediate folded position, and when the changeover is made from the second lifted position to the first lifted position, said lifting drive moves said toggle joint mechanism from the intermediate folded position into the second end position of the toggle joint mechanism.

15. The drive of claim 9, wherein when the changeover is made from the first lifted position to the second lifted position, the lifting drive extends the toggle joint mechanism from the first end position of the toggle joint mechanism via the control lever and moves the toggle joint mechanism beyond the extended position into an intermediate folded position, and when the changeover is made from the second lifted position to the first lifted position, said lifting drive moves said toggle joint mechanism from the intermediate folded position into the second end position of the toggle joint mechanism.

16. The drive of claim 15, wherein the intermediate folded position which the toggle joint mechanism reaches from the first end position is selected such that although the contact system is opened to such an extent that an arc which occurs between the fixed contact and the moving contact in the case of switching off just goes out, the completely opened contact position of the contact system is still not reached.

17. The drive of claim 9, wherein, when the changeover is made from the first lifted position to the second lifted position, the lifting drive extends the toggle joint mechanism from the second end position of the toggle joint mechanism via the control lever, and moves the toggle joint mechanism beyond the extended position directly, without remaining in an intermediate folded position, to the first end position of the toggle joint mechanism.

18. The drive of claim 9, wherein the control lever is not pivoted from the respective control lever end position present at the first lifted position to the respective other control lever end position until the changeover from the second lifted position to the first lifted position.

19. The drive of claim 1, wherein the toggle joint mechanism forms a component of a linkage.

20. The drive of claim 1, wherein the toggle joint mechanism forms a component of a multi joint chain or of a multi-bar linkage.

21. The drive of claim 20, wherein the multi joint chain is a four-joint chain or the multi-bar linkage is a four-bar linkage.

22. A switching device comprising the drive of claim 1.

* * * * *